US012226031B2

(12) United States Patent
Benden et al.

(10) Patent No.: US 12,226,031 B2
(45) Date of Patent: Feb. 18, 2025

(54) DEPLOYABLE BACKREST, FOOTRAIL AND ANTI-FATIGUE MAT ERGONOMIC OFFICE STOOL

(71) Applicant: The Texas A&M University System, College Station, TX (US)

(72) Inventors: Mark E. Benden, College Station, TX (US); Jackson C. Jarman, Richardson, TX (US)

(73) Assignee: The Texas A&M University System, College Station, TX (US)

( * ) Notice: Subject to any disclaimer, the term of this patent is extended or adjusted under 35 U.S.C. 154(b) by 39 days.

(21) Appl. No.: 18/099,815

(22) Filed: Jan. 20, 2023

(65) Prior Publication Data

US 2023/0232993 A1 Jul. 27, 2023

Related U.S. Application Data

(60) Provisional application No. 63/303,828, filed on Jan. 27, 2022.

(51) Int. Cl.
*A47C 7/00* (2006.01)
*A47C 7/50* (2006.01)
*A47C 9/02* (2006.01)

(52) U.S. Cl.
CPC ..... *A47C 9/025* (2013.01); *A47C 7/004* (2013.01); *A47C 7/50* (2013.01)

(58) Field of Classification Search
CPC ..... A47C 7/50; A47C 7/5062; A47C 9/025
See application file for complete search history.

(56) References Cited

U.S. PATENT DOCUMENTS 2,620,863 A * 12/1952 Cooper ..... A61B 90/60 297/461 X
3,245,720 A * 4/1966 Wenger ..... A47C 9/08 248/188.7
3,477,673 A * 11/1969 Bereday ..... A47C 9/025 248/166
3,642,320 A * 2/1972 Ward ..... A47C 7/5064 297/423.38 X
3,820,844 A * 6/1974 Fortnam ..... A61G 15/14 297/423.29 X
4,063,321 A * 12/1977 Nichols ..... B63H 21/22 297/423.19
4,597,356 A * 7/1986 McCaghren ..... B63H 20/12 440/7

(Continued)

FOREIGN PATENT DOCUMENTS

DE 202012011279 U1 * 4/2013 ..... A47C 9/005
EP 1932451 A1 * 6/2008 ..... A47C 9/005

(Continued)

*Primary Examiner* — Rodney B White
(74) *Attorney, Agent, or Firm* — Winstead PC

(57) ABSTRACT

A stool includes a base with a post extending therefrom. A seat is connected to a distal end of the post. In some configurations, the seat may be configured to act as a deployable back rest. A deployable anti-fatigue mat is connected to the base. In some configurations, the deployable anti-fatigue mat is attached to the base via a hinged connection. In some configurations, the deployable anti-fatigue mat is attached to the base with a sliding connection that allows the deployable anti-fatigue mat to slide out from the base.

20 Claims, 6 Drawing Sheets

(56) References Cited

U.S. PATENT DOCUMENTS

| | | | | | |
|---|---|---|---|---|---|
| 4,767,160 | A * | 8/1988 | Mengshoel | A47C 9/005 | 297/423.12 X |
| 4,768,831 | A * | 9/1988 | Liedberg | A47C 9/02 | 297/423.38 X |
| 5,174,631 | A * | 12/1992 | Schaevitz | A47C 7/506 | 297/423.19 X |
| 8,931,848 | B2 * | 1/2015 | Archambault | B60N 3/063 | 297/423.25 X |
| 9,149,678 | B2 * | 10/2015 | Shauli | A47C 9/002 | |
| 9,370,683 | B2 * | 6/2016 | Shauli | A63B 21/0455 | |
| 9,474,377 | B2 * | 10/2016 | Keen | A47C 9/002 | |
| 9,801,472 | B2 * | 10/2017 | Keen | A47C 7/5062 | |
| 9,968,195 | B2 * | 5/2018 | Sheinkop | A47C 7/006 | |
| 10,405,666 | B1 * | 9/2019 | Reus | A47C 9/002 | |
| 10,653,242 | B2 * | 5/2020 | Ortiz | A47C 7/72 | |
| 11,129,480 | B2 * | 9/2021 | Lopez | A47C 7/506 | |
| 11,160,704 | B2 * | 11/2021 | Stajic | A47C 15/004 | |
| 11,850,195 | B2 * | 12/2023 | Stajic | A47C 15/004 | |
| 2006/0238006 | A1 * | 10/2006 | Baranov | A47C 1/0303 | 297/284.3 |
| 2012/0319444 | A1 * | 12/2012 | Onopa | A47C 9/005 | 297/354.12 |
| 2019/0290010 | A1 * | 9/2019 | Guthrie | A47C 7/50 | |
| 2022/0183469 | A1 * | 6/2022 | Deng | A47C 7/002 | |
| 2024/0225287 | A1 * | 7/2024 | Cooper | A47C 7/36 | |

FOREIGN PATENT DOCUMENTS

| | | | | |
|---|---|---|---|---|
| FR | 2718620 | A1 * | 10/1995 | A47C 7/004 |
| JP | H0580349 | U * | 11/1993 | A47C 9/025 |
| KR | 2024071774 | A * | 5/2024 | A47C 3/20 |
| WO | WO-03000092 | A1 * | 1/2003 | A47C 7/004 |

* cited by examiner

DEPLOYABLE BACKREST, FOOTRAIL AND ANTI-FATIGUE MAT ERGONOMIC OFFICE STOOL

CROSS-REFERENCE TO RELATED APPLICATIONS

This patent application claims priority from, and incorporates by reference the entire disclosure of, U.S. Provisional Application 63/303,828 filed on Jan. 27, 2022.

TECHNICAL FIELD

The present invention relates generally to stools for use with standing desks and more particularly, but not by way of limitation, to adjustable-height stools having a deployable backrest and a deployable anti-fatigue mat for use with adjustable-height desks.

BACKGROUND

Research shows that as much as 80% of individuals with adjustable-height desks do not stand at their desks. Fatigue from standing is often the reason individuals with adjustable-height desks opt to sit, despite the known health benefits of standing versus sitting. There are techniques for reducing fatigue from standing, including footrests and floormats. However, these footrests and floormats are left on the floor under the desk and are inconvenient when used with adjustable-height desks due to space limitations under the desk and the inability of desk chairs to roll over the floor mat. Moreover, floor-based footrests and floormats are also a challenge for cleaning crews. Further, floor-based footrests and floormats complicate the management of phone lines and computer cables under the desk. For these reasons, a floor-mounted footrest can be undesirable.

SUMMARY OF THE INVENTION

This summary is provided to introduce a selection of concepts that are further described below in the Detailed Description. This summary is not intended to identify key or essential features of the claimed subject matter, nor is it to be used as an aid in limiting the scope of the claimed subject matter.

According to aspects of the disclosure, a stool includes a base with a post extending therefrom. A seat is connected to a distal end of the post. In some configurations, the seat may be configured to act as a deployable back rest. A deployable anti-fatigue mat is connected to the base. In some configurations, the deployable anti-fatigue mat is attached to the base via a hinged connection. In some configurations, the deployable anti-fatigue mat is attached to the base with a sliding connection that allows the deployable anti-fatigue mat to slide out from the base.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
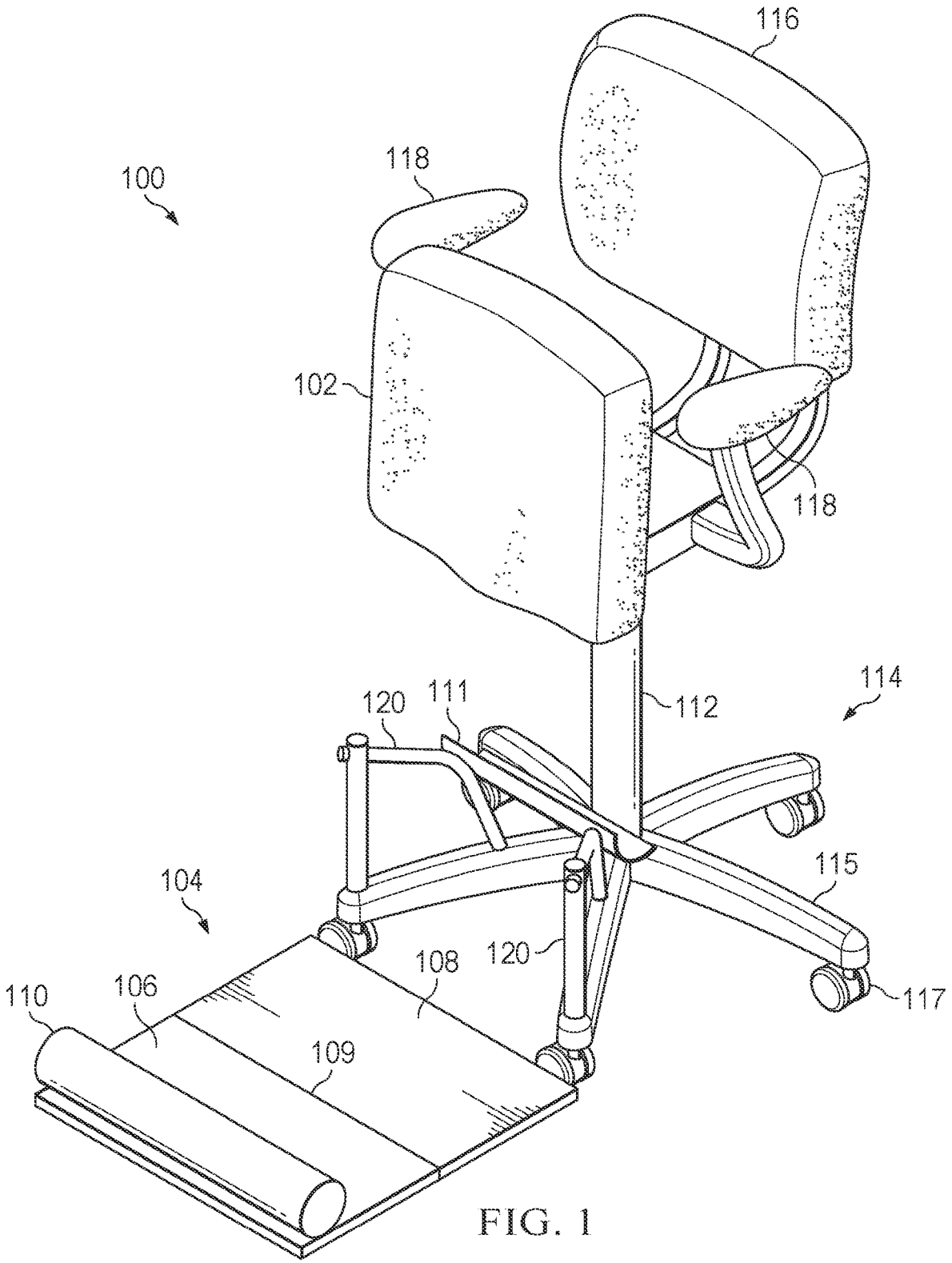
FIG. 1 is a perspective view of a stool having a deployable backrest and a deployable anti-fatigue mat according to an exemplary embodiment.
Figure 2:
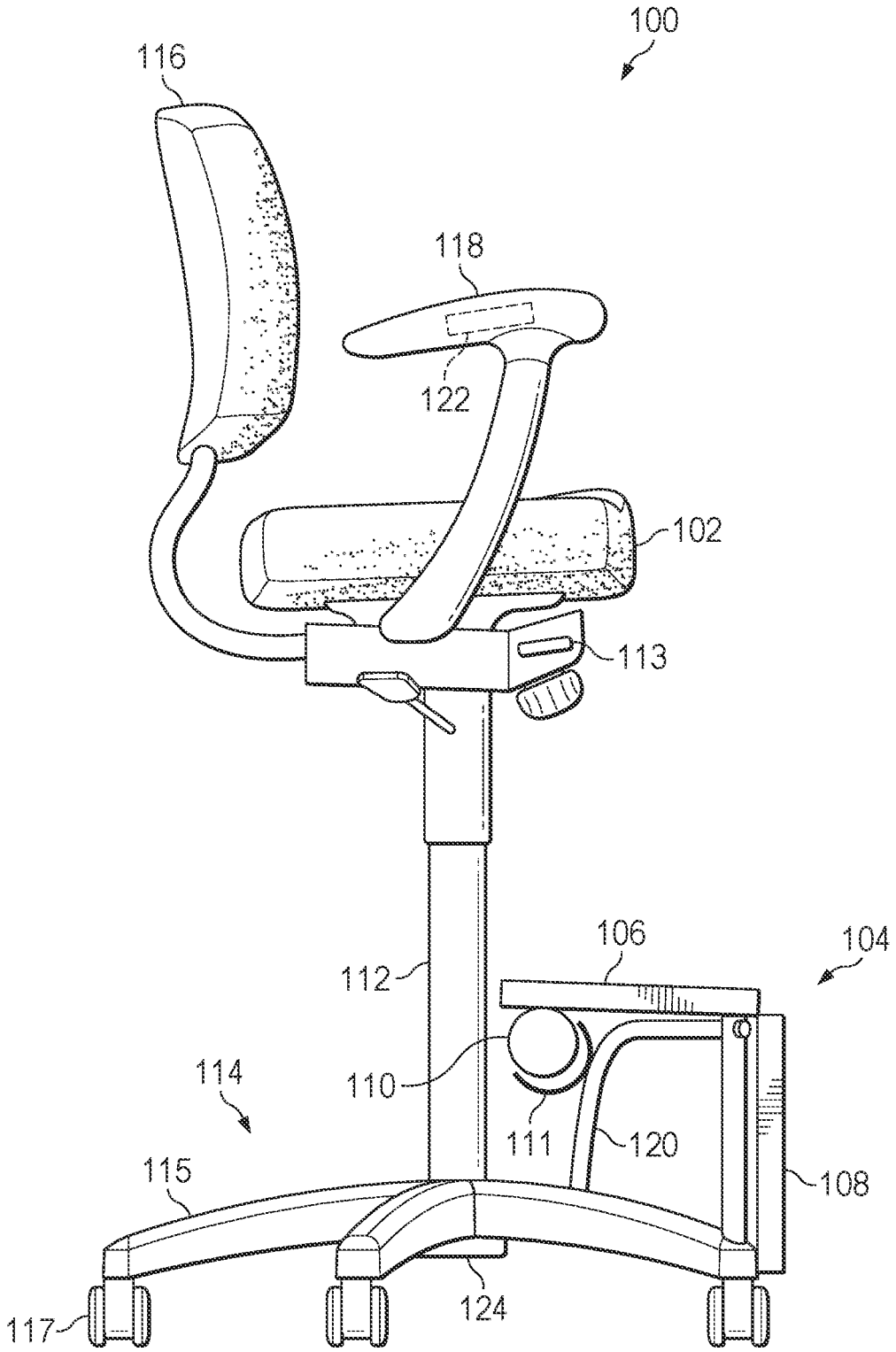
FIG. 2 is a right-side view of the stool of FIG. 1 according to an exemplary embodiment.

FIG. 1 illustrates a perspective view of a stool 100 according to the present disclosure having a deployable backrest 102 and a deployable anti-fatigue mat 104 that is foldably attached to stool 100. FIG. 2 is a side view of stool 100. Stool 100 includes a post 112 and a base 114 that is attached to a lower end of post 112. Base 114 includes of a plurality of legs 115, with each leg 115 including wheels 117. In some embodiments, stool 100 may be configured without wheels 117.

In FIG. 1, deployable backrest 102 is shown in a first position that is generally oriented vertically so that a user of stool 100 may lean against deployable backrest 102. Deployable backrest 102 can be moved into a second position (e.g., see FIG. 2) in which deployable backrest 102 is used as a seat cushion. FIG. 1 also illustrates deployable anti-fatigue mat 104 in a deployed position that is generally oriented horizontally and resting on the floor. Deployable anti-fatigue mat 104 includes a first portion 106 and a second portion 108 that are flexibly joined along a common edge 109. First portion 106 includes a footrest 110. Footrest 110 provides an elevated step for a user to place a foot while standing deployable anti-fatigue mat 104. This practice has been shown to provide relief while standing. With deployable backrest 102 and deployable anti-fatigue mat 104 deployed, stool 100 is configured for the user to stand at a standing or adjustable-height desk with the added comfort of having back support via deployable backrest 102 and a padded surface to stand upon via deployable anti-fatigue mat 104. In some embodiments, stool 100 maybe be configured as a traditional stool without backrest 116 and arm rests 118.

Deployable backrest 102 serves several purposes. In the position shown in FIG. 1, the user may lean against deployable backrest 102 to reduce fatigue and increase comfort while standing, similar to someone leaning against a wall or a bar. In the second position (see FIG. 2), deployable backrest 102 is configured for use as a seat cushion upon which the user sits. Deployable backrest 102 is movably attached to post 112 of stool 100 so that the user may select between these two positions. In various embodiments, post 112 is an elongate member with height adjustability (e.g., a gas lift cylinder etc.). In some embodiments, stool 100 may include a latching system that secures deployable backrest 102 to post 112 in the deployed and undeployed positions for added safety. The latching system may include a lever (e.g., see lever 113 in FIG. 2), a cable-actuated lever, an electronically controlled servo motor and the like. The user actuates the latch to unlock deployable backrest 102 to allow deployable backrest 102 to be moved between the first and second positions. In some embodiments, deployable backrest 102 may be secured to stool 100 via a slotted rail system that allows backrest 102 to be moved by the user between the deployed and undeployed positions. The slotted rail system allows deployable backrest 102 to sit in a lower portion of the slotted rail system to stabilize deployable backrest 102 for the user.

Deployable anti-fatigue mat 104 serves two purposes. In the position shown in FIG. 1, the user stands upon deployable anti-fatigue mat 104. In some embodiments, a top surface of deployable anti-fatigue mat 104 is a padded mat (e.g., rubber, vinyl, standard urethane (variable durometer) or gel) and a bottom surface is a non-padded surface that may be used as a footrest when deployable anti-fatigue mat 104 is in the undeployed position (see FIG. 2). Footrest 110 is an implement for massaging or resting the user's foot and also prevents the user's foot from sliding off of deployable anti-fatigue mat 104. As shown in FIG. 1, deployable anti-fatigue mat 104 is secured to two legs 115 of stool 100. Securing both deployable anti-fatigue mat 104 and deployable backrest 102 to the same structure (i.e., post 112) provides the stability and support needed to allow the user to safely lean against deployable backrest 102 without stool 100 rolling away, as the user's body weight pressing upon deployable anti-fatigue mat 104 anchors stool 100 to the ground.

FIG. 1 illustrates stool 100 with a backrest 116 and a pair of armrests 118 that are attached to post 112. Attaching armrests 118 to post 112 is desirable as doing so prevents the armrests from interfering with the user when deployable backrest 102 is configured as a backrest. Backrest 116 and armrests 118 are used when stool 100 is being used as a traditional stool, as shown in FIG. 2. In other embodiments of stool 100, either or both of backrest 116 and armrests 118 may be eliminated. In some embodiments, stool 100 includes functionality of traditional chairs and/or stools. For example, post 112 may include a gas lift cylinder or equivalent to allow a user to adjust a height of stool 100. In some embodiments, deployable backrest 102, backrest 116, and armrests 118 are rotatably secured to stool 100 so that these components may rotate independent of base 114. In some embodiments, deployable backrest 102, backrest 116, and armrests 118 are fixed to stool 100 so that these components may not rotate independent of base 114.

FIG. 2 is a side view of stool 100 configured for use as a traditional stool. In this configuration, deployable backrest 102 is oriented generally horizontal to act as a seat cushion. Second portion 108 of deployable anti-fatigue mat 104 is oriented generally vertical and first portion 106 is oriented generally horizontal to act as a footrest for the user (and also acts as a step to enable easier entry and exit from stool 100). An additional benefit of deployable anti-fatigue mat 104 in this position is that the mat is not in the way of stool 100 moving around on the floor, and is similarly out of the way for cleaning the floor around stool 100. Base 114 of stool 100 includes a pair of supports 120 upon which first portion 106 rests. Supports 120 provide strength to support the weight of a user standing upon first portion 106 (for example while getting onto or off of stool 100). A tray 111 extends between supports 120 and is configured to receive footrest 110.

In some embodiments, the deployment of deployable anti-fatigue mat 104 may be partially or completely automated. For example, an actuator may be used to move deployable anti-fatigue mat 104 between the deployed and undeployed positions. The actuator may include, for example, a gas lift cylinder, a spring, coil, or torsion member, a pneumatic actuator, an electrical actuator, a hydraulic actuator, and the like. The user may control the actuator via a control mechanism (e.g., button, latch, lever, touch screen control, and the like) associated with stool 100 (e.g., located on post 112 or arm rest 118) or associated with the desk at which the user is working. In some embodiments, power may be supplied to the actuator via a rechargeable battery system. The rechargeable battery system may include an inductive proximity charger (e.g., similar to one used to recharge cell phones). The inductive proximity charger may be positioned so that charging occurs when stool 100 is appropriately positioned relative to the adjustable height desk. For example, an inductive proximity charger 122 may be associated with one arm rest 118 such that the arm rest 118 may be positioned beneath an underside of the adjustable-height desk and aligned with a mating inductive proximity charger to charge the rechargeable battery of the rechargeable battery system. Alternatively, an inductive proximity charger 124 may be associated with base 114 and a mating inductive proximity charger may be positioned on the floor so that positioning base 114 over the mating inductive proximity charger charges the rechargeable battery of the rechargeable battery system.

In some embodiments, a latching system secures deployable anti-fatigue mat 104 to supports 120 for added safety. The user simply actuates the latch to unlock deployable anti-fatigue mat 104 to allow deployable anti-fatigue mat 104 to be moved into the deployed position. The controls for the latching system may be located, for example, on one of the armrests 118 or on post 112 underneath deployable backrest 102.

Figure 3:
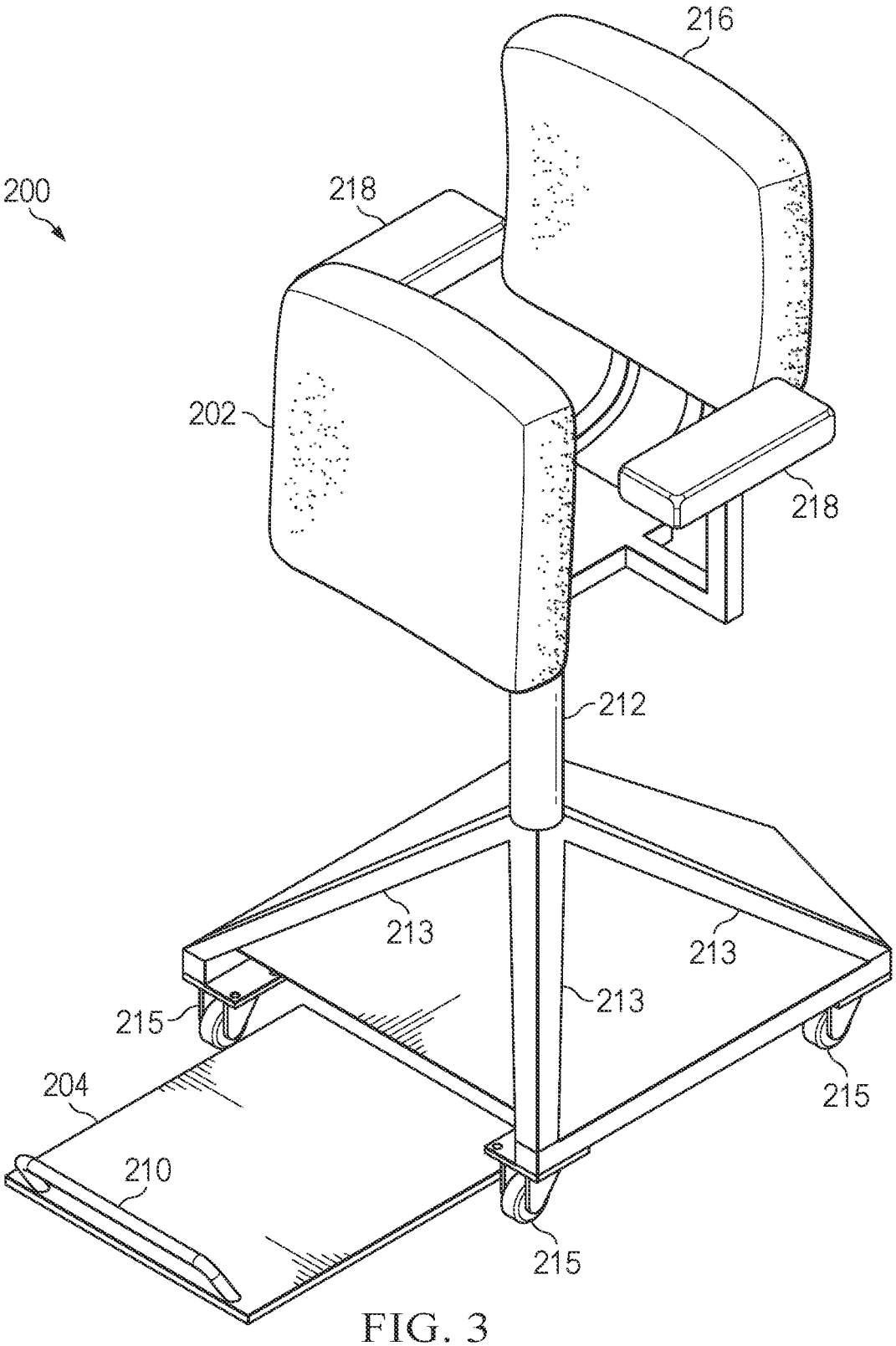
FIG. 3 is a perspective view of a stool having a deployable backrest and a deployable anti-fatigue mat according to an exemplary embodiment.
Figure 4:
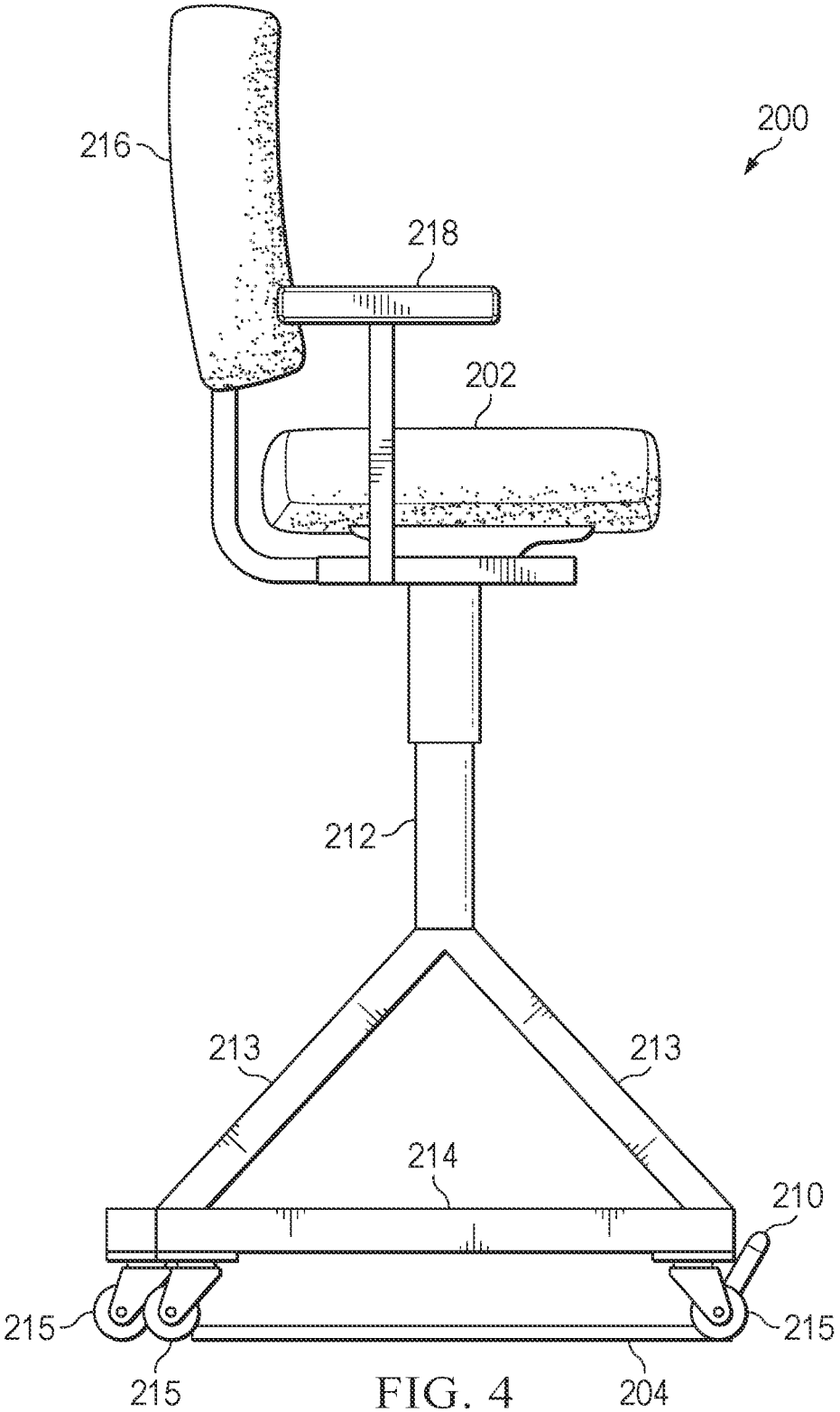
FIG. 4 is a right-side view of the stool of FIG. 3 according to an exemplary embodiment.

FIG. 3 illustrates a perspective view of a stool 200 and FIG. 4 illustrates a side view of stool 200 according to an exemplary embodiment. Stool 200 includes a deployable backrest 202 and a deployable anti-fatigue mat 204. Stool 200 is similar to stool 100 and similar components will be given similar part numbers. Some of the differing aspects of the components of stool 200 relative to stool 100 will be highlighted below.

Stool 200 includes a deployable backrest 202, a deployable anti-fatigue mat 204, a footrest 210, a post 212, base 214, a backrest 216, and armrests 218. Base 214 is a planar structure that is attached to post 212 via legs 213. Deployable backrest 202 is similar to deployable backrest 102 and operates similarly. In contrast to deployable anti-fatigue mat 104, deployable anti-fatigue mat 204 does not unfold for deployment. Instead, deployable anti-fatigue mat 204 slides or travels in and out like a drawer from under base 214. Deployable anti-fatigue mat 204 may be attached to base 214 using rollers/tracks (similar to those used with drawers), a pin and slot system, and the like. A top surface of deployable anti-fatigue mat 204 is a padded mat (e.g., memory foam or the like) and a bottom surface of deployable anti-fatigue mat 204 is made from and/or coated with a low friction material (e.g., polypropylene, delrin, ultra-high molecular weight polyethylene (UHMW) and other slick polymers, surfaces coated with ceramics or polytetrafluoroethylene (PTFE's)) that allows deployable anti-fatigue mat 204 to easily slide across the floor to allow for easy deployment. The sliding arrangement permits deployable anti-fatigue mat 204 to be easily deployed/stowed. An additional benefit of deployable anti-fatigue mat 204 is that the stowed position allows stool 200 to easily move around on the floor without being in the way, and also keeps deployable anti-fatigue mat 204 out of the way for cleaning the floor around stool 200.

In some embodiments, deployable anti-fatigue mat 204 is manually deployed by the user. For example, the user grabs footrest 210 (or uses their foot) to pull deployable anti-fatigue mat 204 out from base 214 or to push deployable anti-fatigue mat 204 back under base 214. In some embodiments, deployment of deployable anti-fatigue mat 204 may be partially or fully automated. For example, deployment of deployable anti-fatigue mat 204 could be automated using an actuator (e.g., a gas lift cylinder, a spring, a coil, or torsion member, a pneumatic actuator, an electrical actuator, and the like). To deploy or retract deployable anti-fatigue mat 204, the user interacts with a control mechanism (e.g., button, latch, lever, touch screen control, and the like) and the actuator deploys/retracts deployable anti-fatigue mat 204. The control mechanism may be located on armrests 218, associated with post 212, or associated with the desk at which the user is working. The user may control the actuator via controls associated with stool 100 (e.g., located on post 212 or armrest 218) or associated with the desk at which the user is working. Similar to stool 100, in some embodiments power may be supplied to stool 200 via a rechargeable battery system. The rechargeable battery system of stool 100 may be similarly incorporated into stool 200 with inductive proximity chargers 122/124 incorporated into an armrest and/or the base of stool 200.

Base 214 is configured with five sets of wheels 215 to provide a large amount of space to accommodate deployable anti-fatigue mat 204. In other embodiments, stool 200 may have more or fewer sets of wheels 215 and deployable anti-fatigue mat 204 can be sized accordingly to fit under base 214.

Figure 5:
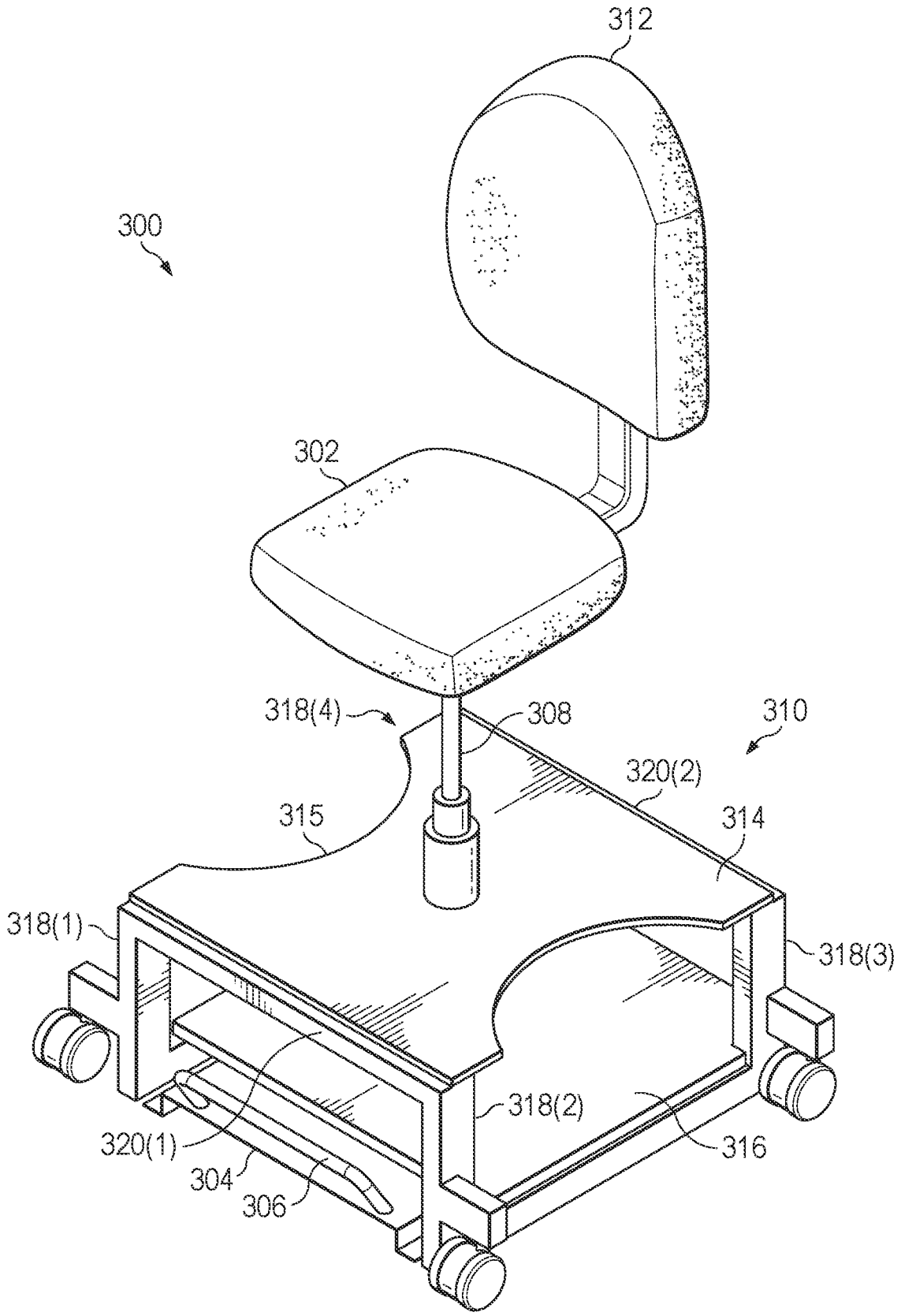
FIG. 5 is a perspective view of a stool having a deployable backrest and a deployable anti-fatigue mat according to an exemplary embodiment.
Figure 6:
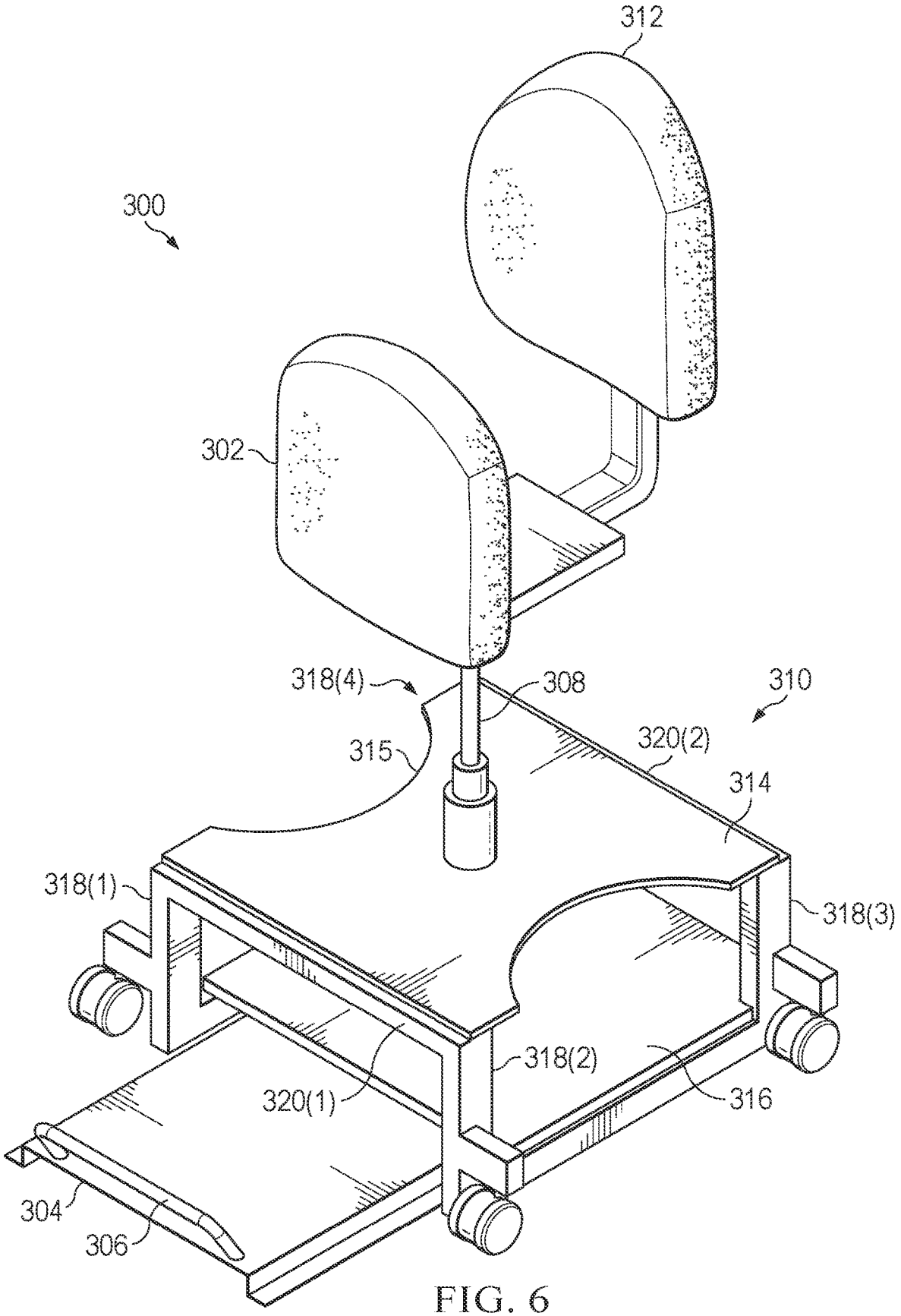
FIG. 6 is a perspective view of the stool of FIG. 5 with the deployable backrest and the deployable anti-fatigue mat in deployed positions according to an exemplary embodiment.

FIGS. 5 and 6 are perspective views of a stool 300 according to an exemplary embodiment. Stool 300 is similar to stool 200 and includes a deployable backrest 302 and a deployable anti-fatigue mat 304. Stool 300 further includes a footrest 306, a post 308, base 310, and a backrest 312. Base 310 includes an upper platform 314, a lower platform 316, and a plurality of vertical supports 318(1)-318(4) that extend therebetween. Upper platform 314 is shown with cutouts 315 that make it easier to access lower platform 316 (e.g., when lower platform 316 is used as a storage shelf). In FIGS. 5 and 6, upper platform 314 is illustrated a planar surface. It will be appreciated that the design of upper platform 314 may be altered. For example, upper platform 314 could comprise a dome-like shape or could be replaced with angled or arcuate legs for either or both of aesthetic reasons and to minimize the collection of dust. A pair of cross supports 320(1)-320(2) connect adjacent vertical supports 318 to increase rigidity and provide more support to base 310. Base 310 is shown configured with four sets of wheels 322. In other embodiments, stool 300 may be configured with more or fewer sets of wheels 322 and deployable anti-fatigue mat 304 can be sized accordingly to fit under base 310. Cross support 320(1) may be used as a footrest when a user is sitting in stool 300.

Deployable backrest 302 serves several purposes. In FIG. 1, deployable backrest 302 is illustrated in a first position that allows deployable backrest 302 to be used as a seat cushion upon which a user may sit. Deployable backrest 302 is configured to be adjusted into a second position that allows deployable backrest 302 to be used as a backrest (e.g., see FIG. 6) against which a user may lean to reduce fatigue and increase comfort while standing. In some embodiments, a lever 303 is actuated by the user to move deployable backrest 302 between the first and second positions.

Deployable anti-fatigue mat 304 slides like a tray from under lower shelf 316. Deployable anti-fatigue mat 304 may be attached to base 310 using rollers/tracks (similar to those used with drawers), a pin and slot system, rails, and the like. A top surface of deployable anti-fatigue mat 304 is a padded mat (e.g., gel mat, foam, rubber, or the like) and a bottom surface of deployable anti-fatigue mat 304 is made from and/or coated with a low friction material (e.g., polypropylene, delrin, ultra-high molecular weight polyethylene (UHMW) and other slick polymers, surfaces coated with ceramics or polytetrafluoroethylene (PTFE's)) that allows deployable anti-fatigue mat 304 to easily slide across the floor to allow for easy deployment. In some embodiments, deployable anti-fatigue mat 304 includes one or more rollers that both support anti-fatigue mat 304 and allow deployable anti-fatigue mat 304 to roll across the floor.

In some embodiments, deployable anti-fatigue mat 304 is manually deployed by the user. For example, the user grabs footrest 306 (or uses their foot) to pull deployable anti-fatigue mat 304 out from base 310 or to push deployable anti-fatigue mat 304 back under base 310. In some embodiments, deployment of deployable anti-fatigue mat 304 may be partially or fully automated. For example, deployment of deployable anti-fatigue mat 304 could be automated using an actuator (e.g., a gas lift cylinder, a spring, a coil, or torsion member, a pneumatic actuator, an electrical actuator, and the like). To deploy or retract deployable anti-fatigue mat 304, the user interacts with a control mechanism (e.g., button, latch, lever, touch screen control, and the like) and the actuator deploys/retracts deployable anti-fatigue mat 304. The control mechanism may be associated with post 308, positioned on an armrest (not shown) of stool 300, or associated with the desk at which the user is working. The user may control the actuator via controls associated with the control mechanism. In some embodiments, power may be supplied to the actuator via a rechargeable battery system. The rechargeable battery system may include an inductive proximity charger (e.g., similar to one used to recharge cell phones). Similar to stools 100/200, in some embodiments power may be supplied to stool 300 via a rechargeable battery system. The rechargeable battery system of stool 100 may be similarly incorporated into stool 300 with inductive proximity chargers 122/124 incorporated into an armrest and/or the base of stool 300.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A stool comprising:

a base;

a post comprising a proximal end connected to the base and a distal end disposed opposite the proximal end;

a seat coupled to the distal end of the post; and a deployable anti-fatigue mat movably attached to the base, wherein the deployable anti-fatigue mat comprises a first portion pivotally joined to a second portion.

2. The stool of claim 1, wherein the deployable anti-fatigue mat is configured to be moved between a first position in which a user can stand upon the deployable anti-fatigue mat and a second position in which the user does not stand upon the deployable anti-fatigue mat.

3. The stool of claim 1, wherein the deployable anti-fatigue mat comprises a footrest.

4. The stool of claim 1, wherein the first portion can be configured as a footrest when the deployable anti-fatigue mat is not deployed.

5. The stool of claim 4, wherein the base comprises a pair of supports upon which the first portion rests when the second portion is configured as a footrest.

6. The stool of claim 1, wherein the deployable anti-fatigue mat is pivotably attached to the base via a hinged connection between the second portion and the base.

7. The stool of claim 1, wherein the deployable anti-fatigue mat is movably attached to the base so that the deployable anti-fatigue mat is configured to translate horizontally between deployed undeployed positions.

8. The stool of claim 1, wherein a bottom surface of the deployable anti-fatigue mat comprises a low-friction material selected from the group consisting of polypropylene, delrin, ultra-high molecular weight polyethylene, ceramic, and polytetrafluoroethylene.

9. The stool of claim 1, wherein the seat is configured as a deployable backrest that may be moved between a first position in which a user can lean against the seat as a backrest for support and a second position in which the user can sit upon the seat as a seat cushion.

10. The stool of claim 1, further comprising an actuator that is configured to deploy the deployable anti-fatigue mat.

11. The stool of claim 10, wherein the actuator is controlled by a control mechanism that is selectively operated by a user.

12. The stool of claim 1, further comprising an actuator that is configured to deploy the seat as a deployable backrest.

13. The stool of claim 1, wherein the base comprises a plurality of wheels that permit the stool to roll across the floor.

14. The stool of claim 1, further comprising a backrest attached to the post.

15. The stool of claim 1, further comprising a pair of armrests attached to the post.

16. The stool of claim 15, further comprising an inductive charge coil positioned on an armrest of the pair of armrests or the base.

17. A method of making a stool comprising a deployable backrest and a deployable anti-fatigue mat, the method comprising:

attaching the deployable backrest to the stool so that the deployable backrest is movable between a first position in which a user can lean against the deployable backrest for support and a second position in which the user can sit upon the deployable backrest as a seat cushion;

attaching the deployable anti-fatigue mat to the stool so that the deployable anti-fatigue mat is movable between a first position in which the user can stand upon the deployable anti-fatigue mat and a second position in which the user does not stand upon the deployable anti-fatigue mat; and attaching an inductive proximity charger to at least one of an armrest of the stool and a base of the stool to allow the stool to charge when the stool is aligned with a proximity charger.

18. A stool comprising:

a base;

a post comprising a proximal end connected to the base and a distal end disposed opposite the proximal end;

a seat coupled to the distal end of the post; and a deployable anti-fatigue mat movably attached to the base, wherein a bottom surface of the deployable anti-fatigue mat comprises a low-friction material selected from the group consisting of polypropylene, delrin, ultra-high molecular weight polyethylene, ceramic, and polytetrafluoroethylene.

19. The stool of claim 18, wherein the deployable anti-fatigue mat comprises a first portion pivotally joined to a second portion.

20. The stool of claim 18, further comprising an actuator that is configured to deploy at least one of the deployable anti-fatigue mat and the seat as a deployable backrest.

* * * * *